United States Patent [19]

Rupnik

[11] Patent Number: 4,572,602

[45] Date of Patent: Feb. 25, 1986

[54] ELECTRICAL CONNECTOR ASSEMBLY WITH GUIDE MEMBER

[75] Inventor: David W. Rupnik, Mechanicsburg, Pa.

[73] Assignee: AMP Incorporated, Harrisburg, Pa.

[21] Appl. No.: 666,708

[22] Filed: Oct. 31, 1984

[51] Int. Cl.[4] ..... H01R 13/74

[52] U.S. Cl. ..... 339/65; 339/91 R; 339/126 R; 339/132 R

[58] Field of Search ..... 339/65, 91 R, 125 R, 339/126 R, 126 RS, 132 R, 132 B, 133 R, 134

[56] References Cited

U.S. PATENT DOCUMENTS

| | | | |
|---|---|---|---|
| 4,040,699 | 8/1977 | Rasmussen | 339/126 R |
| 4,146,292 | 3/1979 | Garrett | 339/125 R |
| 4,350,401 | 9/1982 | Allen et al. | 339/65 |
| 4,406,509 | 9/1983 | Jagen | 339/91 R |
| 4,458,973 | 7/1984 | Hayes et al. | 339/91 R |
| 4,494,815 | 1/1985 | Brzostek et al. | 339/126 R |

*Primary Examiner*—John McQuade

*Attorney, Agent, or Firm*—Robert W. J. Usher

[57] ABSTRACT

A plug and socket assembly (20, 31) includes a guide member for guiding a plug (20) through a panel aperture into a receptacle (31) comprises a face plate (12) having a generally rectangular plug admitting orifice (13) therein and a channel section base portion (14) outstanding perpendicularly from one side of the face plate (12) and extending completely through the thickness thereof to define a lower edge portion of the orifice. An apron (15) outstands perpendicularly from an upper edge portion of the orifice (13) to overlie the center of the channel and latch admitting openings (16, 16') extend between the channel side walls and the apron (15).

3 Claims, 3 Drawing Figures

ELECTRICAL CONNECTOR ASSEMBLY WITH GUIDE MEMBER

Figure 1:
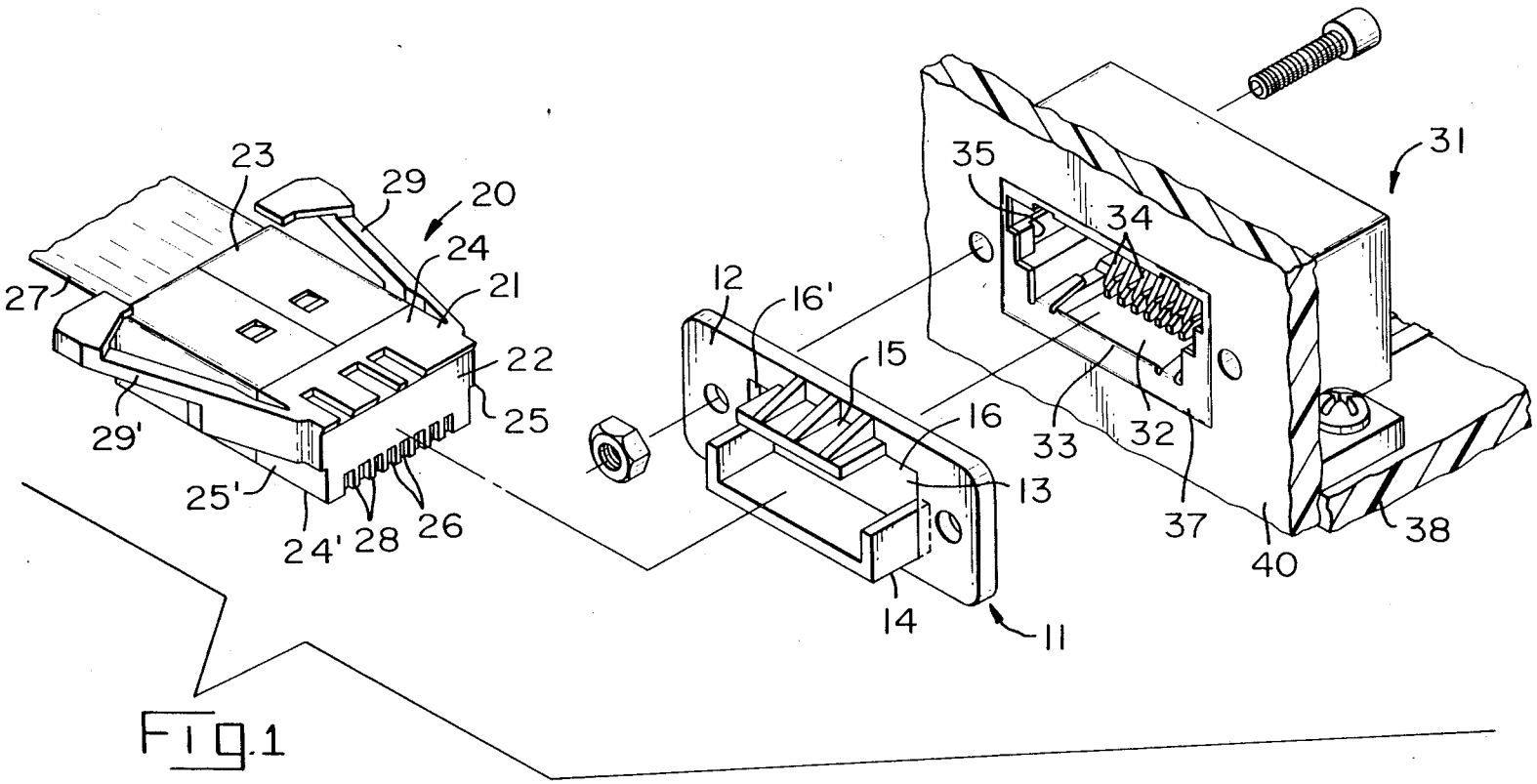

The invention relates to an electrical connector assembly, in particular, to a plug and socket assembly for use in telecommunication or data transmission applications, including a plug guide member.

A typical plug of the assembly is similar to that described in U.S. Pat. No. 4,458,973, the disclosure of which is incorporated herein by reference, and comprises an insulating housing body having a front, mating end and a rear, wire receiving end; first and second opposed side walls joined by first and second opposed end walls extending between the mating and wire receiving ends, a row of barriers extending across the second side wall at the mating end, an internal, wire receiving passageway open at the rear end and extending toward the mating end; a row of terminals having contact surfaces exposed between adjacent barriers and wire connecting portions terminating wires in the passageway; and, a pair of latch arms extending rearwardly in divergent fashion from respective endwalls at locations adjacent the first side wall.

A typical receptacle comprises an insulating housing having opposite side and end walls defining a plug receiving cavity open at a mouth; a row of spring contacts extending rearwardly from a location adjacent and spaced from the mouth across the cavity for engagement with respective contact surfaces on insertion of the plug through the mouth into the cavity; and, latching means adjacent the mouth interengageable with the latch arms to latch the plug in the cavity.

In view of the close spacing of the plug and receptacle contacts, it is important that the plugs and receptacle are in precise alignment when mated. For this reason, the profile of the receptacle mouth usually conforms substantially to the cross-sectional profile of the mating end of the plug. However, it has been found that, in some blind-mating applications where the receptacle is concealed behind an aperture in a bulkhead or panel, there is still a tendency for the user to attempt to mate plugs with the receptacles with a small degree of misalignment, which may, nevertheless, be sufficient to risk ineffective or incomplete electrical connection.

According to the invention, there is provided a plug guiding member extending around the panel aperture and including a channel-form base portion outstanding from one side of the panel with the channel axis extending along the plug mating axis and an apron outstanding from the panel overlying the centre of the channel, latch admitting openings being provided between respective opposite side walls and the upper guiding portion.

The plug is insertable through the guide member as a sliding fit with the channel snugly receiving the second side wall and adjacent portions of the end walls and the apron engaging a central portion of the first side wall with the latch arms being freely received in the openings thereby to guide the plug into the receptacle cavity in a precise orientation.

Preferably, the channel-form base portion extends completely through the guide member to minimize the unsupported distance of travel of the plug during mating.

The guide member ensures guiding of the plug throughout the entire mating movement.

It is envisaged that the guide member may be integrally formed with the panel.

Figure 2:
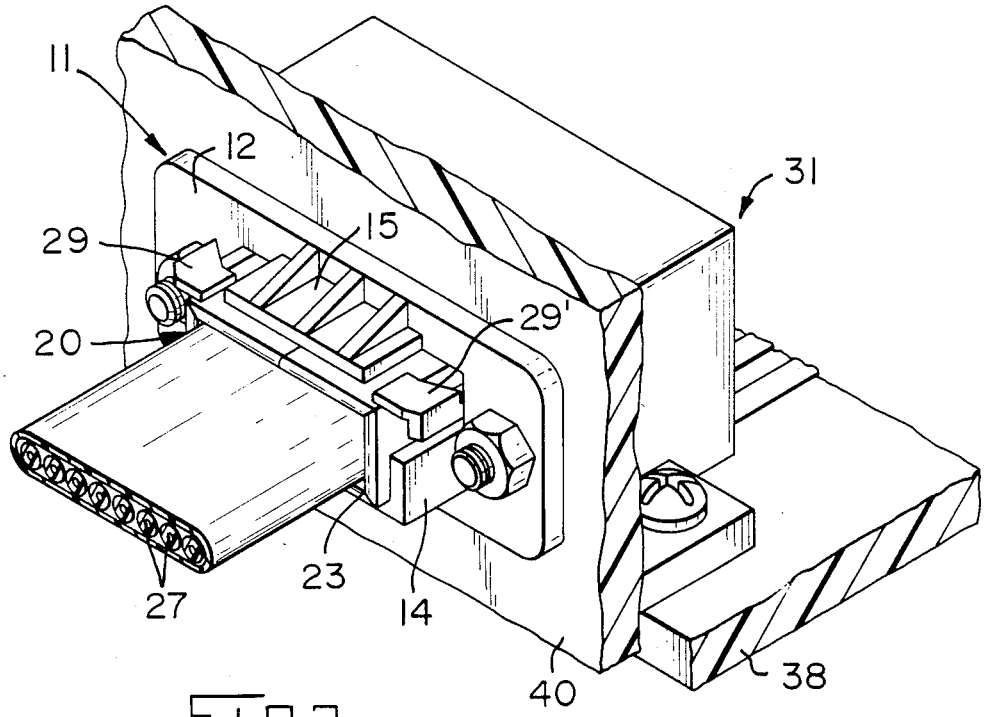
Figure 3:
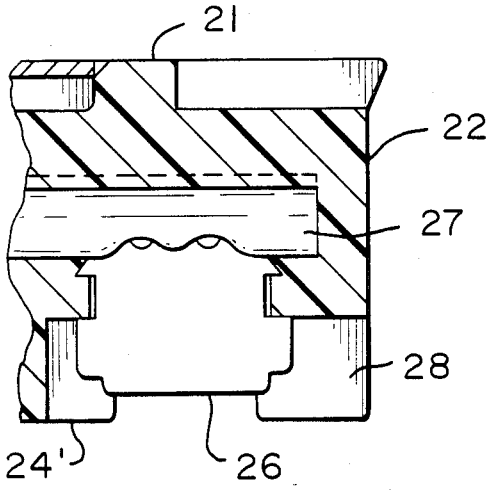

An example of the invention will now be described with reference to the accompanying drawings in which:

FIG. 1 is an exploded isometric view of an electrical assembly according to the invention, FIG. 2 is an isometric view of the electrical assembly; and, FIG. 3 is a fragmentary view of the plug of the assembly.

The guide member 11 comprises a face plate 12 having a generally rectangular plug admitting orifice 13 therein and a channel section base portion 14 outstanding perpendicularly from one side of the face plate and extending completely through the thickness thereof to define a lower edge portion of the orifice 13. An apron 15 outstands perpendicularly from an upper edge portion of the orifice 13 to overlie the centre of the channel providing latch admitting openings 16, 16' extending between the channel side walls and the apron.

The plug member 20 comprises an insulating housing body 21 having a front, mating end 22 and a rear, wire connecting end 23. First and second opposed side walls 24, 24' joined by first and second opposed end walls 25, 25' extending between the mating and wire receiving ends. A row of barriers 28 extends across the second side wall at the mating end and an internal wire receiving passageway is open at the rear end and extends toward the mating end. A row of terminals has contact surfaces 26 exposed between adjacent barriers and wire connecting portions terminating wires 27 in the passageway. A pair of latch arms 29, 29' extend rearwardly in divergent fashion from respective endwalls at locations adjacent the first side wall 24.

The receptacle 31 comprises an insulating housing having opposite side and end walls defining a plug receiving cavity 32 open at a mouth 33 and a row of spring contacts 34 extending rearwardly from a location adjacent and spaced from the mouth across the cavity for engagement with respective contact surfaces on insertion of the plug through the mouth into the cavity, latching means 35 being provided adjacent the mouth interengageable with the latch arms to latch the plug in the cavity.

A stamped and formed shield 37 is provided around the mouth similar to that described in U.S. Pat. No. 4,457,575, the disclosure of which is incorporated herein by reference.

To effect assembly, the receptacle is mounted on a printed circuit board 38 adjacent one side of a panel 40 with the mouth aligned with an aperture in the panel. The face plate 12 of the guide member is affixed by screws to the other side of the panel with the orifice 13 aligned with the aperture. On presenting a plug for mating, the first side wall and adjacent end walls of the plug are received as a sliding fit in the channel section base portion of the guide member with the apron in sliding engagement with the second wall resulting in a progressive confinement of the plug during insertion through the aperture. The latches move freely through the openings 16, 16' and cooperate with the latch means in the receptacle cavity to secure the plug and socket in mating engagement. The guide member also guides the plug during disengagement from the socket assisting in the prevention of damage to the plug during the final stages of passage through the aperture.

I claim:

1. An electrical connector assembly comprising:

a plug comprising an insulating housing body having a front, mating end and a rear, wire receiving end; first and second opposed side walls joined by first and second opposed end walls extending between the mating and wire receiving ends; a row of barriers extending across the second side wall at the mating end; an internal wire receiving passageway open at the rear end and extending toward the mating end; a row of terminals having contact surfaces exposed between adjacent barriers and wire connecting portions terminating wires in the passageway; and, a pair of latch arms extending rearwardly in divergent fashion from respective end walls at locations adjacent the first side wall;

a receptacle comprising an insulating housing having opposite side and end walls defining a plug receiving cavity open at a mouth and a row of spring contacts extending rearwardly from a location adjacent and spaced from the mouth across the cavity for engagement with respective contact surfaces of the plug terminals on insertion of the plug through the mouth into the cavity, latching means being provided adjacent the mouth interengageable with the latch arms to latch the plug in the cavity;

a panel having an aperture therein; and, a plug guiding member located to extend around the panel aperture and including a channel-form base portion outstanding from one side of the panel with the channel axis extending along the plug mating axis and an apron outstanding from the panel overlying the center of the channel, latch admitting openings being provided between respective channel side walls and the upper apron portion;

wherein the receptacle is mounted on the other side of the panel with the mouth aligned with the panel aperture and the plug extends through the guide member in mating engagement with the receptacle with the channel snugly receiving the second side wall and adjacent portions of the end walls of the plug and the apron engaging a central portion of the first side wall with the latch arms being freely received in the openings.

2. An electrical connector assembly according to claim 1 in which the channel-form base portion extends completely through the guide member.

3. A guide member for guiding a plug through a panel aperture into a receptacle comprising a face plate having a generally rectangular plug admitting orifice therein and a channel section base portion outstanding perpendicularly from one side of the face plate and extending completely through the thickness thereof to define a lower edge portion of the orifice, an apron outstanding perpendicularly from an upper edge portion of the orifice to overlie the centre of the channel and latch admitting openings extending between the channel side walls and the apron.

* * * * *